US007055820B2

(12) United States Patent
Saito et al.

(10) Patent No.: US 7,055,820 B2
(45) Date of Patent: Jun. 6, 2006

(54) SHEET DISCHARGE DEVICE AND SHEET PROCESSING DEVICE USING THE SAME

(75) Inventors: Manabu Saito, Iwatsuki (JP); Kenji Kanai, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/749,392

(22) Filed: Jan. 2, 2004

(65) Prior Publication Data

US 2004/0256790 A1 Dec. 23, 2004

(30) Foreign Application Priority Data

May 9, 2003 (JP) ..... 2003-132203

(51) Int. Cl.
*B65H 39/10* (2006.01)

(52) U.S. Cl. ..... 271/298; 271/65; 271/301; 399/107; 399/110; 399/124

(58) Field of Classification Search ..... 271/65, 271/303, 298, 301, 163; 399/107, 110, 124, 399/405

See application file for complete search history.

(56) References Cited

U.S. PATENT DOCUMENTS 4,587,532 A * 5/1986 Asano ..... 346/134
6,112,047 A * 8/2000 Kato et al. ..... 399/381
2003/0116911 A1* 6/2003 Kanai ..... 271/303
2003/0198494 A1* 10/2003 Kenji et al. ..... 399/381

FOREIGN PATENT DOCUMENTS

JP 10-129912 * 5/1998
JP 2000-302311 10/2000

* cited by examiner

*Primary Examiner*—Kathy Matecki
*Assistant Examiner*—Thomas Morrison
(74) *Attorney, Agent, or Firm*—Morgan, Lewis & Bockius, LLP

(57) ABSTRACT

The present invention can easily change an accommodatable number of discharge sheet. Further, the present invention provides a sheet processing device that can easily change the accommodatable number of discharge sheet while aiming to miniaturize the device itself. The present invention provides a sheet discharge device that is incorporated as a part of a processing device body and discharges a sheet processed at a processing section in the processing device body toward a sheet stacking section disposed at an upper section of the processing device body, the sheet discharge device having a unit receiving section formed at the processing device body, wherein plural sheet discharge units each having a different specification can be attached to the unit receiving section. Further, the present invention includes a sheet processing device using the same.

16 Claims, 16 Drawing Sheets

SHEET DISCHARGE DEVICE AND SHEET PROCESSING DEVICE USING THE SAME

BACKGROUND OF THE INVENTION

1. Field of the Invention

The present invention relates to a sheet discharge device incorporated in a sheet processing device such as copying machine and printer as a part of the body of the processing device, and more particularly to an improvement of a sheet discharge device capable of commonizing an external unit such as a duplex unit and a sheet processing device using the same.

2. Description of the Prior Arts

An image forming device will be taken as an example of this type of a sheet discharge device. There has been conventionally known the one having an imaging engine including, for example, a photoreceptor drum and the like mounted in a body of an image forming device (body of a processing device) and provided with a sheet feeding device and a discharge tray in the body of the processing device, wherein a sheet transport path from the sheet feeding device to the discharge tray is formed at the imaging engine. In this device, an image is formed at the imaging engine with an electrophotographic system, whereupon the image formed by the imaging engine is transferred onto a sheet such as a paper and the like supplied from the sheet feeding device. Thereafter, the image is fixed onto the sheet by a fixing device, and then, the sheet having the image fixed thereon is discharged onto the discharge tray.

This type of the image forming device has a sheet discharge device incorporated therein at an outlet section of the body of the processing device.

A sheet discharge device conventionally used is the one having a pair of discharge rollers integrally incorporated therein at the outlet section of the fixing device unit.

Further, there has already been proposed a sheet discharge device provided with two discharge trays, i.e., upper and lower discharge trays, and discharged sheets are respectively distributed to be discharged onto the upper and lower discharge trays, in order to improve the accommodatable number of sheets in the discharge tray (for example, see Patent Reference 1).

[Patent Reference 1]

Japanese Published Unexamined Patent Application No. 2000-302311 (preferred embodiments of the invention, FIG. 1)

However, the sheet discharging position to the discharge tray is fixed to only one position in this type of the sheet discharge device, whereby the accommodatable number of the discharge sheet of the discharge tray is inevitably limited. Therefore, it is difficult for a user to change the accommodatable number of the discharge sheet.

For example, a technique disclosed in the Patent Reference 1 teaches a two-stage construction of the discharge tray, so that the accommodatable number of sheets is increased compared to the one having one-stage discharge tray, but it is impossible to change the respective accommodatable numbers of sheets of the respective discharge trays.

Therefore, the conventional technique has a technical problem that, if the user demands to remarkably increase the accommodatable number of sheets, an add-on large-capacity sheet stacking device has to be additionally mounted or the image forming device itself has to be changed to the type of large-capacity model.

Further, in order to add a duplex unit for performing a duplex recording to a sheet as an external unit, the sheet is required to be discharged in a direction different from the direction toward the discharge tray (normally, in the direction reverse to the direction toward the discharge tray), thereby entailing a technical problem that the external unit is required to have a different specification in the sheet discharge unit having a different specification.

With respect to these technical problems, it is considered that an adapter is respectively added to the external units. However, in this embodiment, a separate adapter is required every specification, thereby causing a fear that the construction of the device is likely to be complicated.

SUMMARY OF THE INVENTION

The present invention is accomplished for solving the abovementioned technical problems, and aims to provide a sheet discharge device that can use a common external unit among plural sheet discharge units each having a different specification.

Further, the present invention provides a sheet processing device that can use plural sheet discharge units while aiming to miniaturize the device itself, and further, that can use a common external unit among plural sheet discharge units, with the use of the aforesaid sheet discharge device.

Specifically, as shown in FIG. 1 and FIGS. 2A and 2B, the present invention is a sheet discharge device that is incorporated as a part of a processing device body 1 and discharges a sheet processed at a processing section in the processing device body 1 toward a sheet stacking section 2 disposed at an upper section of the processing device body 1, comprising a unit receiving section 3 formed at the processing device body 1, wherein plural sheet discharge units 4 each having a different specification (for example, 4*a*, 4*b*) are mounted to the unit receiving section 3 so as to be attached thereto and detached therefrom, each sheet discharge unit 4 having a normal discharge path 5 directing toward the sheet stacking section 2 and a reverse discharge path 6 that is branched from the way of the normal discharge path 5 to extend toward a direction of a reverse discharge and that communicates with a sheet transport path 13 of an external unit connectable to a side of the processing device body 1, and a discharge port 7 of the reverse discharge path 6 is set to the same position in the plural discharge units each having a different specification.

In a model shown in FIG. 1, a fixing device 14 for fixing an unfixed image on the sheet is provided, separate from the sheet discharge unit 4, at the body of the processing device 1, but the invention is not necessarily limited to this embodiment. The construction can suitably be selected such that, for example, the fixing device 14 can be incorporated into the sheet discharge unit 4.

The sheet discharge device widely includes an embodiment for discharging a processed sheet in this technical system, but the assumption is made that the sheet discharge device is the one incorporated in the processing device body 1.

Therefore, the sheet discharge device according to the present invention has a requirement of "being incorporated as a part of the processing device body 1". Specifically, the sheet discharge device according to the present invention is one component of the processing device body 1, so that a sheet discharge device optionally added is excluded.

Moreover, "the sheet stacking device 2 disposed at the upper section of the processing device body 1" includes not only an embodiment constituted of an upper cover of the processing device body 1 but also an embodiment wherein a tray member is separately disposed on this processing device body 1.

Further, the unit receiving section 3 widely includes a receiving section to which the plural sheet discharge units 4 (e.g., 4*a*, 4*b*) each having a different specification are attachable.

In this case, the unit receiving section 3 may have a common space to which the sheet discharge units 4 each having a plural specification can be attached, and normally, may be provided with an engaged section corresponding to an engaging section of the sheet discharge unit 4.

The typical embodiment of the engaged section includes a positioned section, a mounted section and the like. As for these engaged sections, all of them may be made common to the plural sheet discharge units 4 each having a different specification, or a part of them may be common, or they may be made totally independent.

Further, the reverse discharge path 6 does not include a portion of the normal discharge path 5 directing toward the sheet stacking section 2. Specifically, a discharge member 8 is positioned in the vicinity of a discharge port of the normal discharge path 5. In the present embodiment, the discharge port 7 on the side of the sheet discharge unit 4 that transports a sheet to an external unit such as a duplex unit and the like after the sheet is reversed to be discharged is set to the same position, whereby the "reverse discharge path 6 of the sheet that is reversed to be discharged" is provided and its "discharge port 7" is also set to the same position in the plural sheet discharge units 4 (e.g., 4*a*, 4*b*).

"The discharge port 7 of the reverse discharge path 6 is set to the same position" in the plural sheet discharge units 4 each having a different specification means that, when the external unit is added to the present device, a sheet feeding port at the external unit and the discharge port 7 of the present sheet discharge unit 4 are respectively at the position capable of receiving and sending the sheet.

It is to be noted that the sheet discharge unit 4 according to the present invention has at least the normal discharge path 5 and the reverse discharge path 6, and in addition to these, it may be provided with a different discharge path. Further, in this case, it is preferable to provide a switching mechanism 10 in the sheet discharge unit 4, the switching mechanism 10 preferably utilizing a switching member.

Additionally, it is needless to say that "the plural sheet discharge units 4 each having a different specification are attachable" includes, for example, an embodiment wherein the sheet discharge unit 4 is made removable in a market, but it is not limited thereto. It also includes an embodiment wherein the sheet discharge unit 4 is attached upon the shipment and the sheet discharge unit 4 is not attached/detached in the market.

Since the invention discloses "the plural sheet discharge units 4 each having a different specification", so that a device for a single sheet discharge unit is excluded.

Further, the sheet discharge unit 4 is only a unit for discharging a sheet. Considering an exchangeability of the sheet discharge unit 4 at the market, it is preferably the one that is removable to the unit receiving section 3.

In this case, the sheet discharge unit 4 can simply be exchanged, thereby being capable of easily dealing with maintenance. Further, if the sheet discharge units 4 (e.g., 4*a*, 4*b*) each having a different specification and each having a different sheet discharge port (specifically, a discharge port of the normal discharge path 5) are provided, for example, the change of the accommodatable number of discharge sheets can easily be handled.

Moreover, the sheet discharge unit 4 of the present invention is provided with the discharge member 8 (see FIG. 2) disposed proximate to an upper surface of the sheet stacking section 2 disposed at the upper section of the processing device body 1 from the viewpoint of the positional relationship to the sheet stacking section 2.

An embodiment for increasing or decreasing a capacity of a discharge sheet onto the sheet stacking section 2 may include the one wherein the each of the plural sheet discharge units 4 each having a different specification has a height from the upper surface of the sheet stacking section 2 to the discharge member 8 with the sheet discharge unit 4 attached to the unit receiving section 3.

Further, as a typical selection basis, the discharge capacity of a sheet may be set variably according to a sheet transporting speed, sheet feeding amount or sheet processing amount (for example, a processing amount of a sheet by a processing section of an image forming device) of the processing device body 1.

A sheet transporting speed of the processing device body 1 is taken as an example. In the case where the sheet transporting speed is fast, a sheet discharge unit 4 (e.g., 4*b*) having a large height from the upper surface of the sheet stacking section 2 to the discharge member 8 with the sheet discharge unit 4 attached to the processing device body 1 may be attached, while a sheet discharge unit 4 (e.g., 4*a*) having a small height may be attached in the case where the sheet transporting speed is slow.

Further, each sheet discharge unit 4 may have at least the normal discharge path 5 for discharging a sheet to the sheet stacking section 2 and the reverse discharge path 6 in the direction of a reverse discharge from the normal discharge path 5 as shown in FIGS. 2A and 2B. The number of the sheet discharge paths and its layout or the number of the discharge member 8 and its layout can suitably be selected according to need.

In this embodiment, it is preferable to provide at least a roller member at the lower wall of the normal discharge path 5 from the viewpoint of reducing a transport resistance for enhancing transportability of a sheet that is reversed to be discharged from the normal discharge path 5.

From the viewpoint of reducing the transport resistance in the reverse discharge path 6, it is preferable to have a configuration such that at least upper and lower wall faces of the reverse discharge path 6 are formed so as not to block a linear reference surface connecting a nipping section of the discharge member 8 in the vicinity of the discharge port of the normal discharge path 5 and a lower edge of the discharge port 7 of the reverse discharge path 6.

It is also preferable to upwardly withdraw an upper wall of the reverse discharge path 6 from an extending surface of an upper wall of the normal discharge path 5 for preventing the upper wall from becoming an obstacle when the sheet is reversed to be discharged.

Further, it is also preferable to form the lower walls of the normal discharge path 5 and the reverse discharge path 6 into an approximately V-shape for widening a space in the vicinity of a crossing section of the normal discharge path 5 and the reverse discharge path 6, whereby the sheet that is reversed to be discharged can easily advance to the reverse discharge path 6.

Moreover, the present invention is not limited to the abovementioned sheet discharge device. A sheet processing device having these incorporated therein is included in the present invention.

In the case where an image forming device is used as the sheet processing device, it is necessary to incorporate an imaging engine 11 or a sheet feeding device 12 as a processing section.

Further, the present invention includes, as an embodiment of a sheet processing device, an embodiment wherein an external unit such as a duplex unit or a post-processing unit is attached to the discharge port 7 of the reverse discharge path 6.

BRIEF DESCRIPTION OF THE DRAWINGS

Preferred embodiments of the present invention will be described in detail based on the following, wherein.

DESCRIPTION OF THE PREFERRED EMBODIMENT

Embodiment 1

Figure 1:
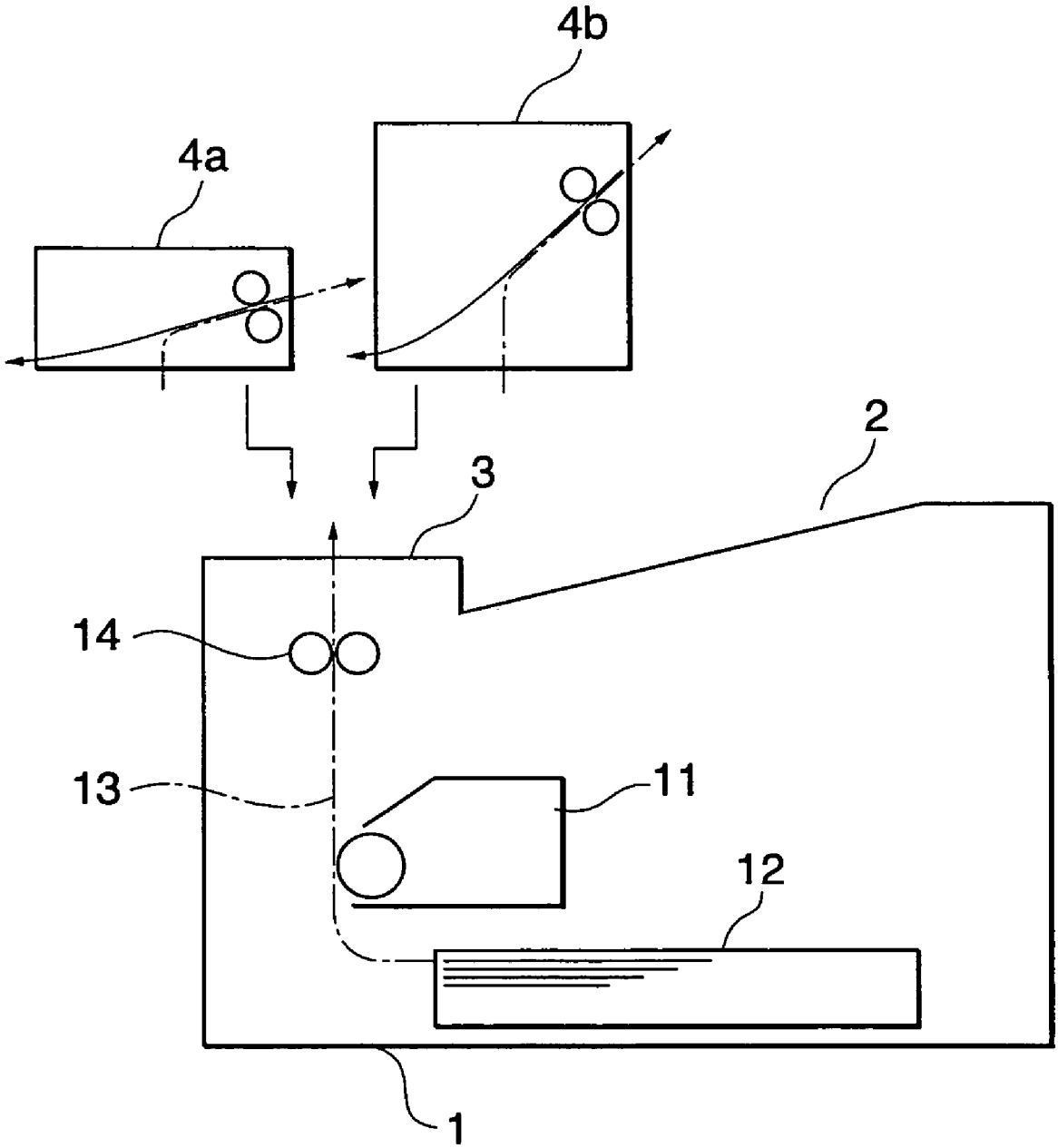
FIG. 1 is an explanatory view showing a sheet discharge device according to the present invention and an outline of an image forming device using the same.
Figure 2B:
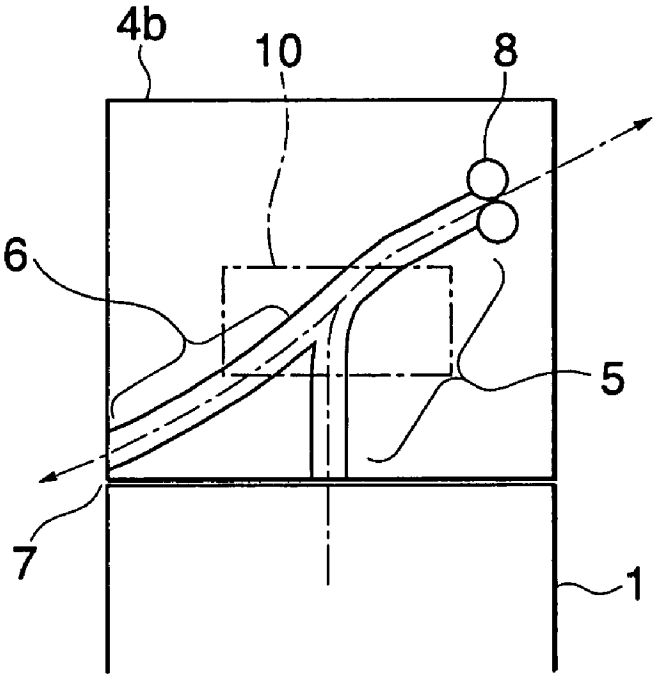
FIG. 2B is an explanatory view showing a state wherein a sheet discharge unit is attached to the sheet discharge device according to the present invention.
Figure 2A:
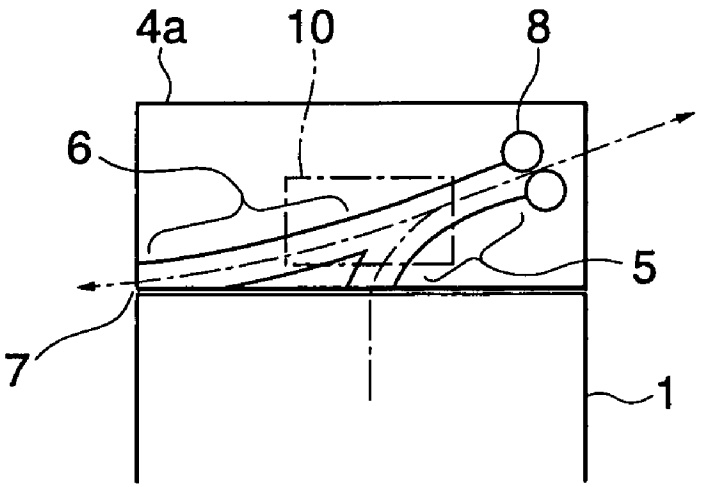
FIG. 2A is an explanatory view showing a state wherein a sheet discharge unit is attached to the sheet discharge device according to the present invention.
Figure 3:
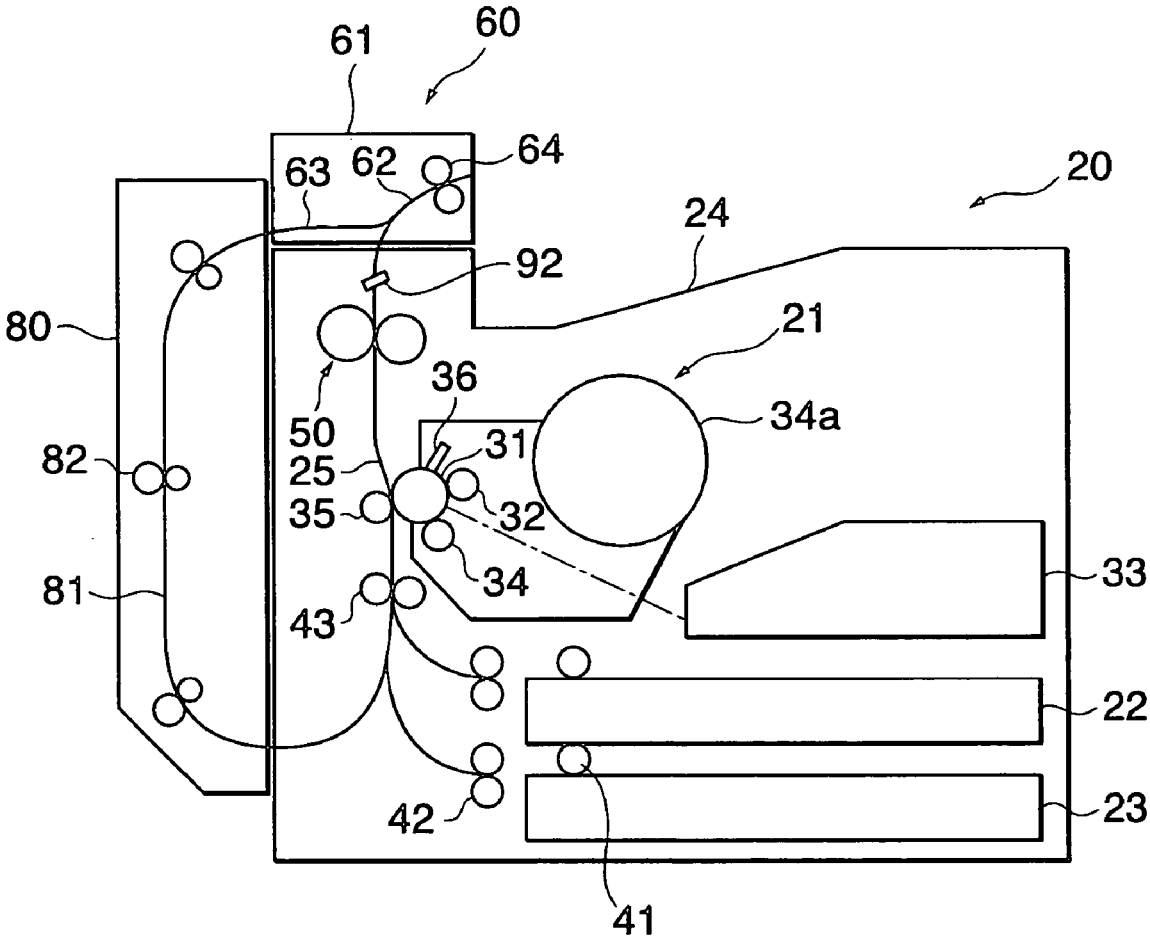
FIG. 3 is an explanatory view showing a sheet processing device to which the present invention is applied according to an embodiment 1.

FIG. 3 is an explanatory view showing an overall construction of a sheet processing device (image forming device in this embodiment) to which the present invention is adopted according to the embodiment 1.

In the same figure, the image forming device has an imaging engine 21 mounted in a device body 20 (corresponding to the processing device body). Sheet feeding devices 22, 23 of a predetermined number (two-stage construction in this embodiment) are disposed below the imaging engine 21 and a sheet transport path 25 extending in an approximately vertical direction from sheet feeding devices 22, 23 is provided toward a discharge tray 24 at the upper section of the device body 20.

In this embodiment, the imaging engine 21 adopts the one using an electrophotographic system, and is provided with a photoreceptor drum 31, a charging device (e.g., charging roller) 32 for charging this photoreceptor drum 31, an optical unit (e.g., laser scanning device) 33 for writing a latent image on this photoreceptor drum 31 with optical beam, a developing device 34 for making the latent image on the photoreceptor drum 31 visible with toner serving as a developer, a transferring device (e.g., transfer roller) 35 for transferring the visible image (toner image) on the photoreceptor drum 31 and a cleaning device (e.g., blade cleaning device) 36 for cleaning residual toner on the photoreceptor drum 31.

In this embodiment, the photoreceptor drum 31, charging device 32, developing device 34 and cleaning device 36 are integrated as one process cartridge that is configured to be removable to the device body 20. It is to be noted that the developing device 34 has a removable toner cartridge 34*a* in this embodiment.

Further, in this embodiment, the sheet feeding devices 22, 23 each have a pickup roller 41 for taking and transporting a sheet and a separating roller (e.g. a combination of a feed roller and a retard roller) 42 for separating the taken-out sheet one by one.

Additionally, suitable number of transport roller (not shown) is disposed on the sheet transport path 25. A resist roller 43 for positioning the sheet is disposed immediately before the upstream side of a transferring section of the photoreceptor drum 31 while a fixing device 50 is disposed at the downstream side of the transferring section of the photoreceptor drum 31. A discharge sensor 92 for detecting the discharge of the sheet is disposed at the downstream side of this fixing device 50.

Further, in this embodiment, a sheet discharge device 60 is mounted at the outlet section of the sheet transport path 25. This sheet discharge device 60 is assembled as a part of the device body 20 and has a sheet discharge unit 61 that is removable to the device body 20.

In this embodiment, the sheet discharge unit 61 is, for example, the one having an embodiment with reduced sheet discharge capacity (e.g., 250 discharge sheets). It has a normal discharge path 62 passing through the fixing device 50 and extending toward the discharge tray 24 at the upper section of the device body 20 and a reverse discharge path 63 that is branched from the way of the normal discharge path 62 to extend toward the direction reverse to the normal discharge path 62.

Disposed in front of the reverse discharge path 63 is a duplex unit 80 that, when a duplex mode is selected for performing an image recording on both sides of the sheet, takes the sheet having one side recorded therein from the sheet discharge device 60, transports the sheet along an internal sheet returning transport path 81 with the transport roller 82 of a suitable number and feeds the sheet again to the resist roller 43.

Numeral 64 denotes a discharge roller provided on the normal discharge path 62 for discharging the sheet.

Figure 4:
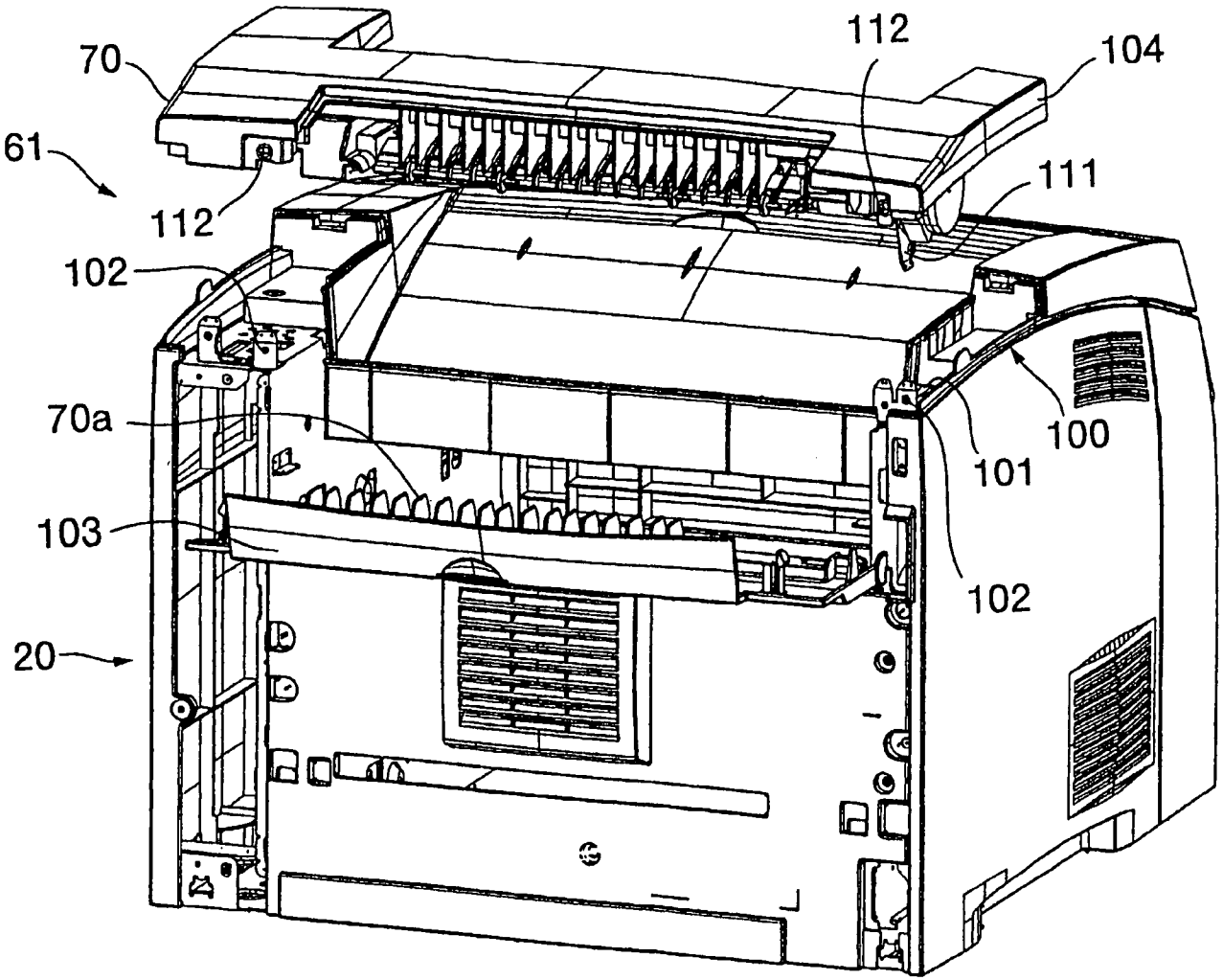
FIG. 4 is a perspective view of the sheet processing device of the present embodiment.

In this embodiment in particular, the sheet discharge unit 61 is removably attached to a unit receiving section 100 provided at the upper section of the device body 20 as shown in FIGS. 3 and 4.

In this case, a locking projection 111 and a screw bearing recess section 112 as an engaging section are provided at a unit body 70 while a locking hole 101 and a screwed member 102 as an engaged section that can be engaged with the engaging sections 111 and 112 are provided at the unit receiving section 100 as shown in FIG. 4. The sheet discharge unit 61 is attached such that the engaging sections 111 and 112 are engaged with the engaged sections 101 and 102 for fixing the sheet discharge unit 61 with a screw (not shown).

It is to be noted that, in this embodiment, a part 70*a* of the unit body 70 is removably attached to an opening/closing door 103 of the device body 20. Further, numeral 104 in the figure denotes an outer cover of the sheet discharge unit 61.

Figure 5:
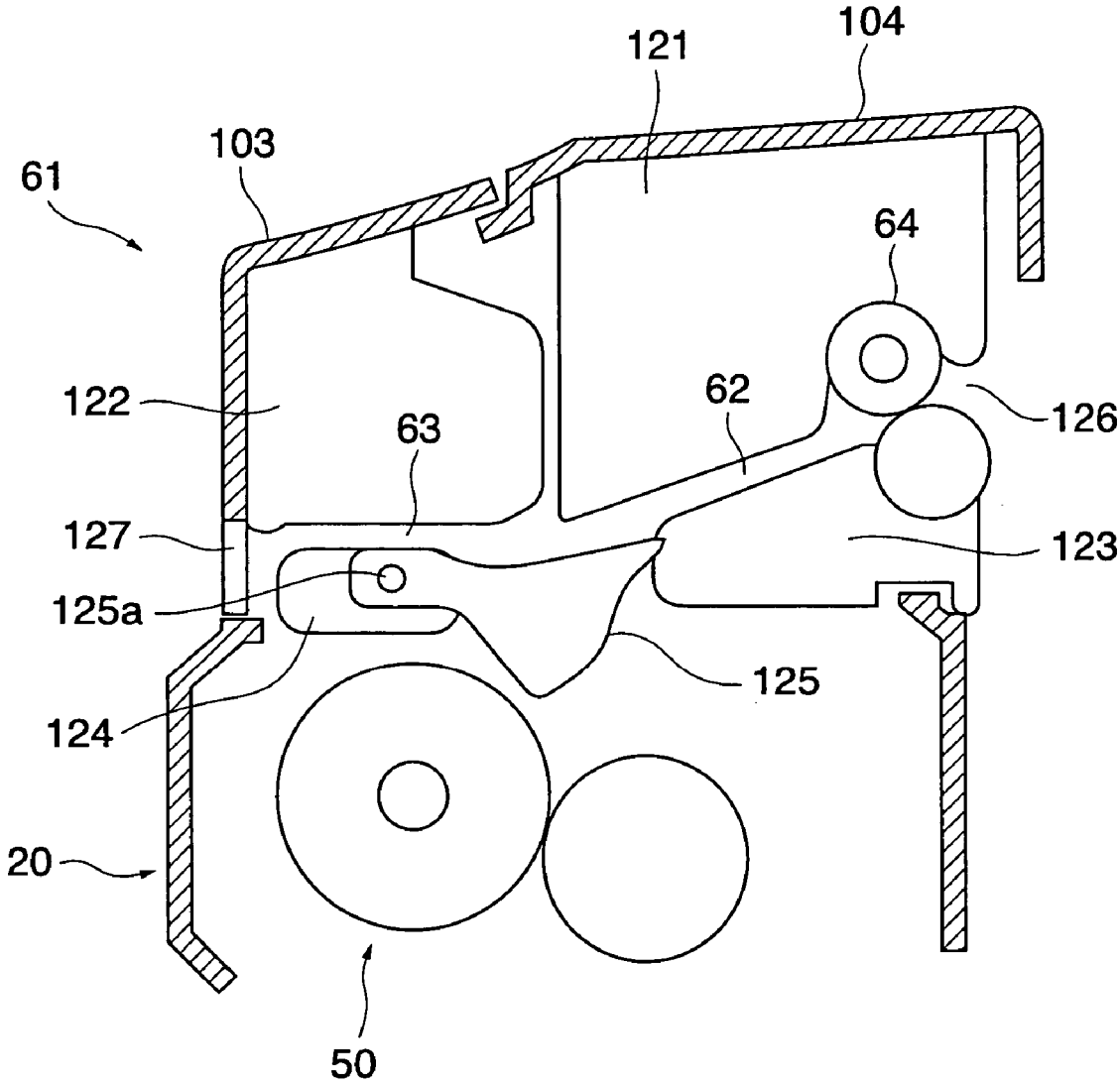
FIG. 5 is an explanatory view showing details of a sheet discharge unit used in the present embodiment.

In this embodiment, as shown in FIG. 5, the sheet discharge unit 61 forms the normal discharge path 62 with upper and lower guide members 121 and 123, and forms the reverse discharge path 63 with upper and lower guide members 122 and 124, wherein a movable gate 125 is disposed between the lower guide members 122 and 124.

Further, the movable gate 125 is pivotably mounted at the lower guide member 124 with a shaft 125*a*, whereby it is normally positioned at the lower section as shown in the figure by its own weight for establishing a communication between the normal discharge path 62 and the reverse discharge path 63. Moreover, a recess section 125*b* is formed at the movable gate 125, so that a wide space produced by the presence of this recess section 125*b* is assured at the crossing section of the normal discharge path 62 and the reverse discharge path 63. It is to be noted that numeral 126 denotes a discharge port of the normal discharge path 62 and numeral 127 denotes a discharge port of the reverse discharge path 63.

This sheet discharge unit 61 does not have, for example, an original driving source. A transmission gear 58 is geared with a part of a driving force transmission system 53 of the fixing device 50 and a driven gear 59 coaxially mounted to the driving roller of the discharge roller 64 is geared with the transmission gear 58, thereby transmitting driving force (see FIG. 12).

Although the sheet discharge unit 61 does not have the original driving source but utilizes driving force from the driving transmission system 53 in this embodiment, the invention is not limited thereto. The driving force may be provided in the sheet discharge unit 61 or other driving force may be utilized.

Subsequently explained is an operation of the image forming device according to this embodiment.

As shown in FIG. 3, a predetermined toner image is formed on the photoreceptor drum 31 at the imaging engine 21. On the other hand, a sheet is fed to the sheet transport path 25 from one of the sheet feeding devices 22 and 23, and then, the toner image on the photoreceptor drum 31 is transferred onto the sheet by the transferring device 35. The sheet on which the image is transferred is subject to a fixing process at the fixing device 50, and then, discharged to a predetermined discharge section (e.g., sheet tray) via the sheet discharge device 60.

Residual toner on the photoreceptor drum 31 is removed by the cleaning device 36 for preparing for the next imaging cycle.

In this image forming process, attention is particularly paid on the sheet discharge device 60, the operation of which will be explained with reference to FIG. 6.

Figure 6B:
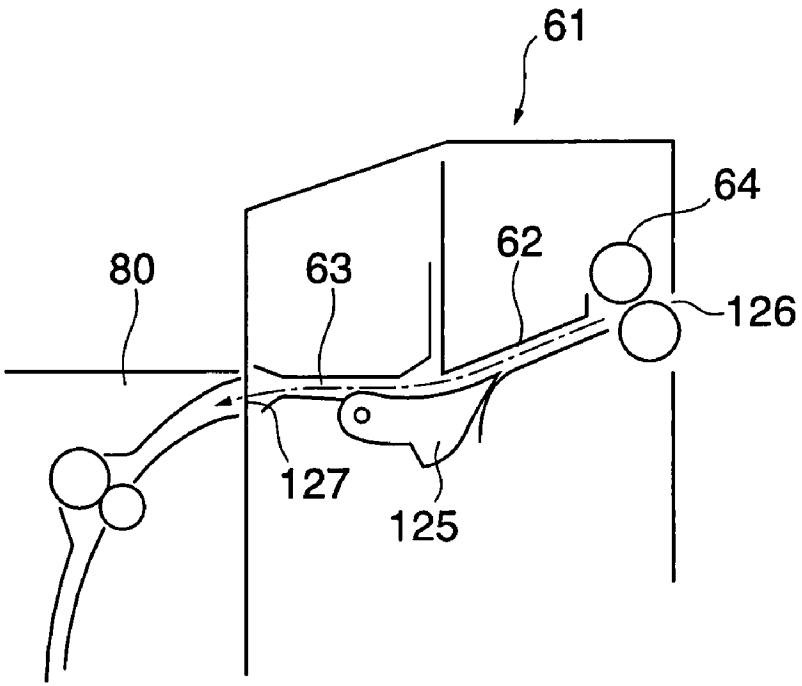
FIGS. 6A and 6B are explanatory views showing an operation of the sheet discharge unit used in the present embodiment.
Figure 6A:
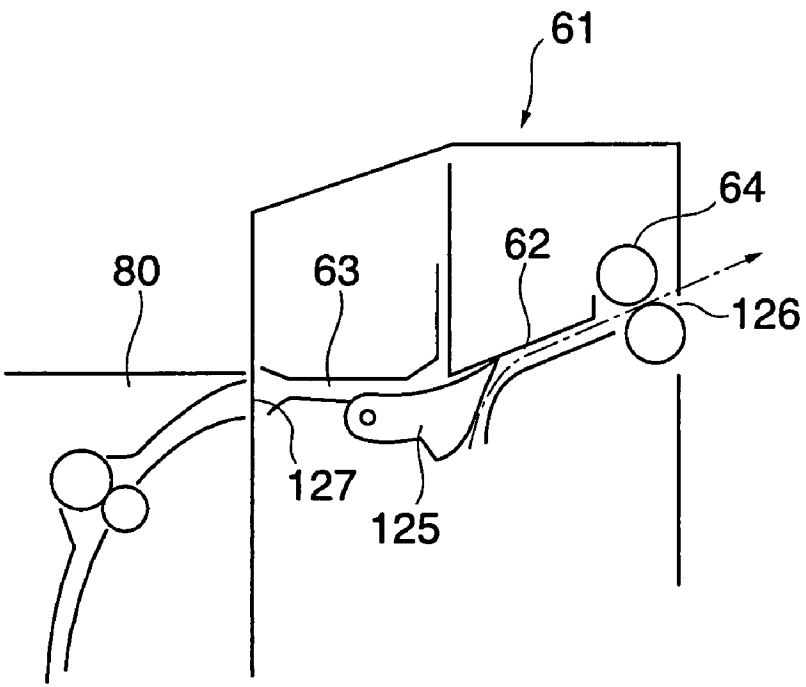

The sheet passing through the sheet transport path 25 is fixed by the fixing device 50, and then, pushes the movable gate 125 in the upward direction in the figure to advance into the normal discharge path 62 (see FIG. 6A). Then, it is nipped by the discharge roller 64, passes through the discharge port 126 in this state and discharged to the discharge tray 24.

In the case where the duplex unit 80 is attached as an external unit to the device body 20 and a duplex recording is selected, for example, the sheet pushes up the movable gate 125 with the leading edge thereof to advance into the normal discharge path 62, followed by being nipped by the discharge roller 64 of the sheet discharge unit 61. When the trailing edge of the sheet passes through the movable gate 125 after the trailing edge of the sheet passes through the discharge sensor 92, the movable gate 125 returns to the initial position by its own weight, thereby establishing a communication between the normal discharge path 62 and the reverse discharge path 63. The discharge roller 64 that is driven to rotate in the normal direction is then driven to rotate in the reverse direction, whereby the sheet advances toward the reverse discharge path 63 as shown in FIG. 6B, to thereby be transported to the duplex unit 80.

The operation timing of the discharge roller 64 is based upon a detection signal of the discharge sensor 92.

Figure 7:
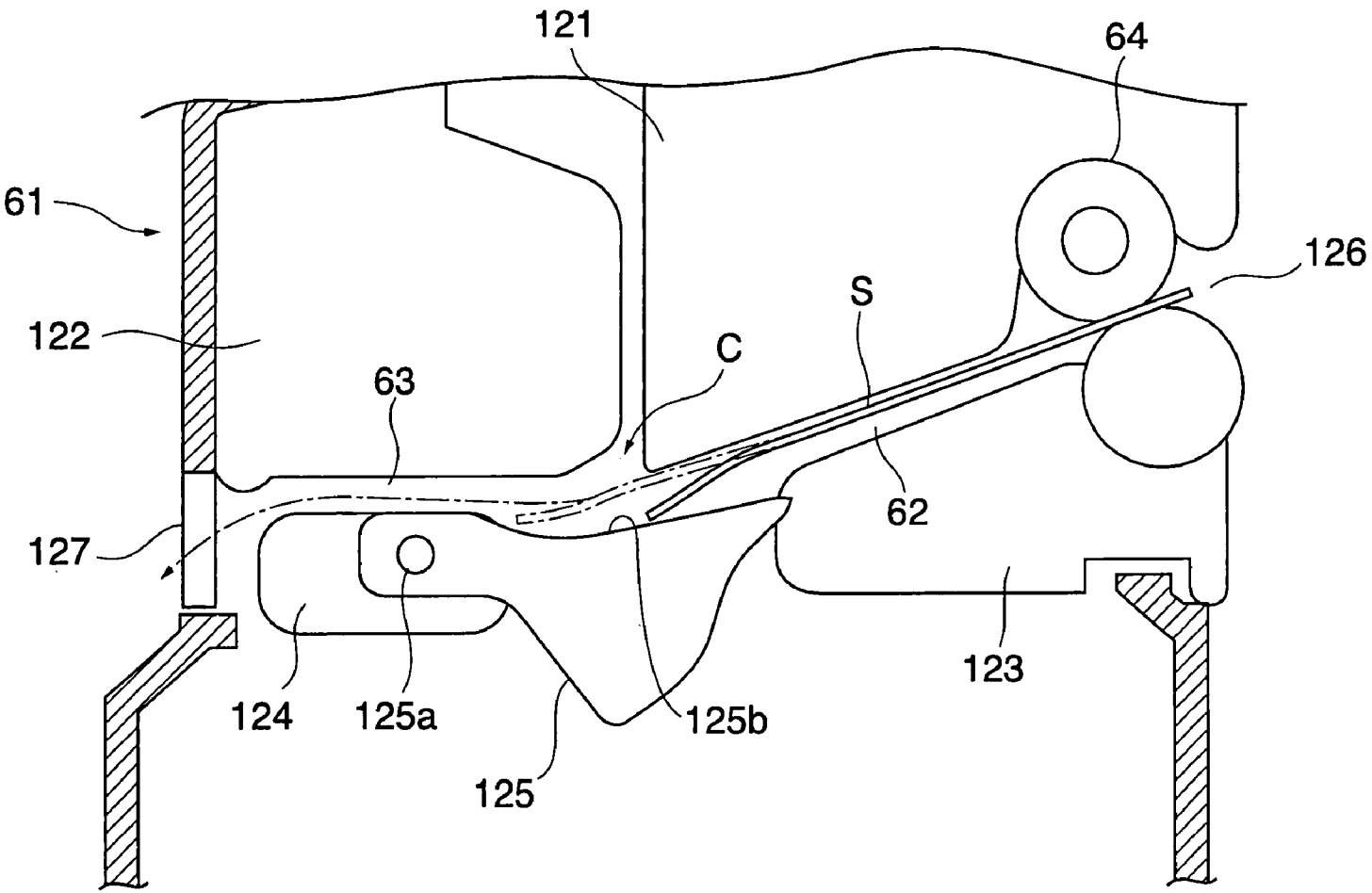
FIG. 7 is an explanatory view showing an operation when a thick paper is transported in the present embodiment.

A detailed operation in the process for reversing and discharging the sheet in this embodiment will be explained along FIG. 7. Since a curling amount becomes remarkable for handling thick paper in particular, the present invention explains the subject upon discharging the sheet mainly about the transporting state of a thick paper (specifically, a paper with approximately 200 g/m$^2$ compared to normal paper with 64 g/m$^2$).

A sheet S reversed to be transported by the discharge roller 64 is conveyed along the upper and lower guide members 121 and 123 of the normal discharge path 62. When the leading edge of the sheet S reaches the movable gate 125, the sheet S is transported along the recess section 125*b* of the movable gate 125. The upper guide member 122 defining an upper wall section of the reverse discharge path 63 is positioned above an extending surface of the upper guide member 121 defining an upper wall section of the normal discharge path 62 in the vicinity of the crossing section C of the normal discharge path 62 and the reverse discharge path 63, that produces a wide space. Therefore, the leading edge of the sheet S transported to the reverse discharge path 63 is directed toward the discharge port 127 with its advance not hindered.

Figure 8:
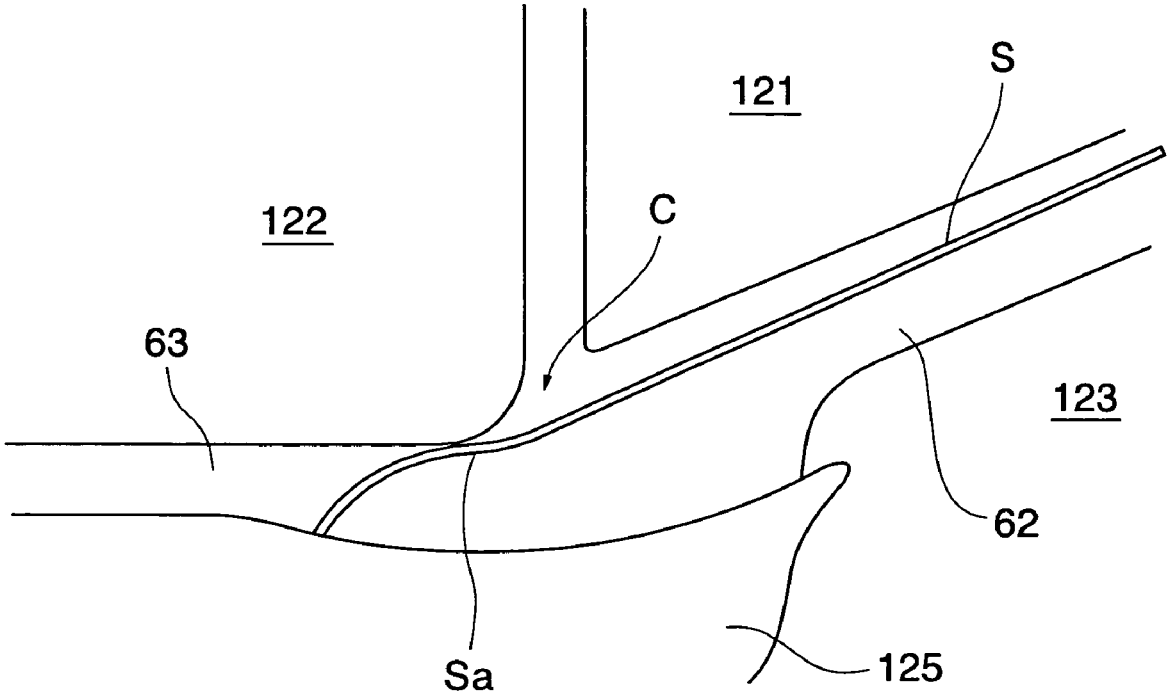
FIG. 8 is an explanatory view showing an operation when a thick paper is transported in a reference embodiment.

If the upper guide member 122 of the reverse discharge path 63 is disposed below the extending surface of the upper guide member 121 of the normal discharge path 62, the space in the vicinity of the crossing section C becomes narrow as shown in FIG. 8, so that the section Sa in the vicinity of the leading edge of the sheet S reaching the section C comes in contact with the upper guide member 122 of the reverse discharge path 63, that buckles the sheet S from around the section Sa. Therefore, frictional resistance at this section becomes great, thereby extremely deteriorating transportability of the sheet S.

Further, the lower wall section of the normal discharge path 62 and the reverse discharge path 63 is formed into approximately a V-shape, thereby being capable of suppressing a transport resistance of the sheet S, but the invention is not limited thereto. For example, it maybe formed linearly.

Moreover, instead of providing the movable gate 125, a fixed gate may be utilized. In this case, the fixed gate may be arranged in the vicinity of the lower guide member 123 of the normal discharge path 62.

As described above, the sheet processing device according to the present embodiment has the sheet discharge unit 61 having a sheet discharge capacity of, for example, 250 sheets, wherein a sheet can accurately be transported to the external unit provided in the reverse-discharge direction of the sheet S and further, there is a possibility that a type of sheet that can be handled widely ranges.

Embodiment 2

Figure 9:
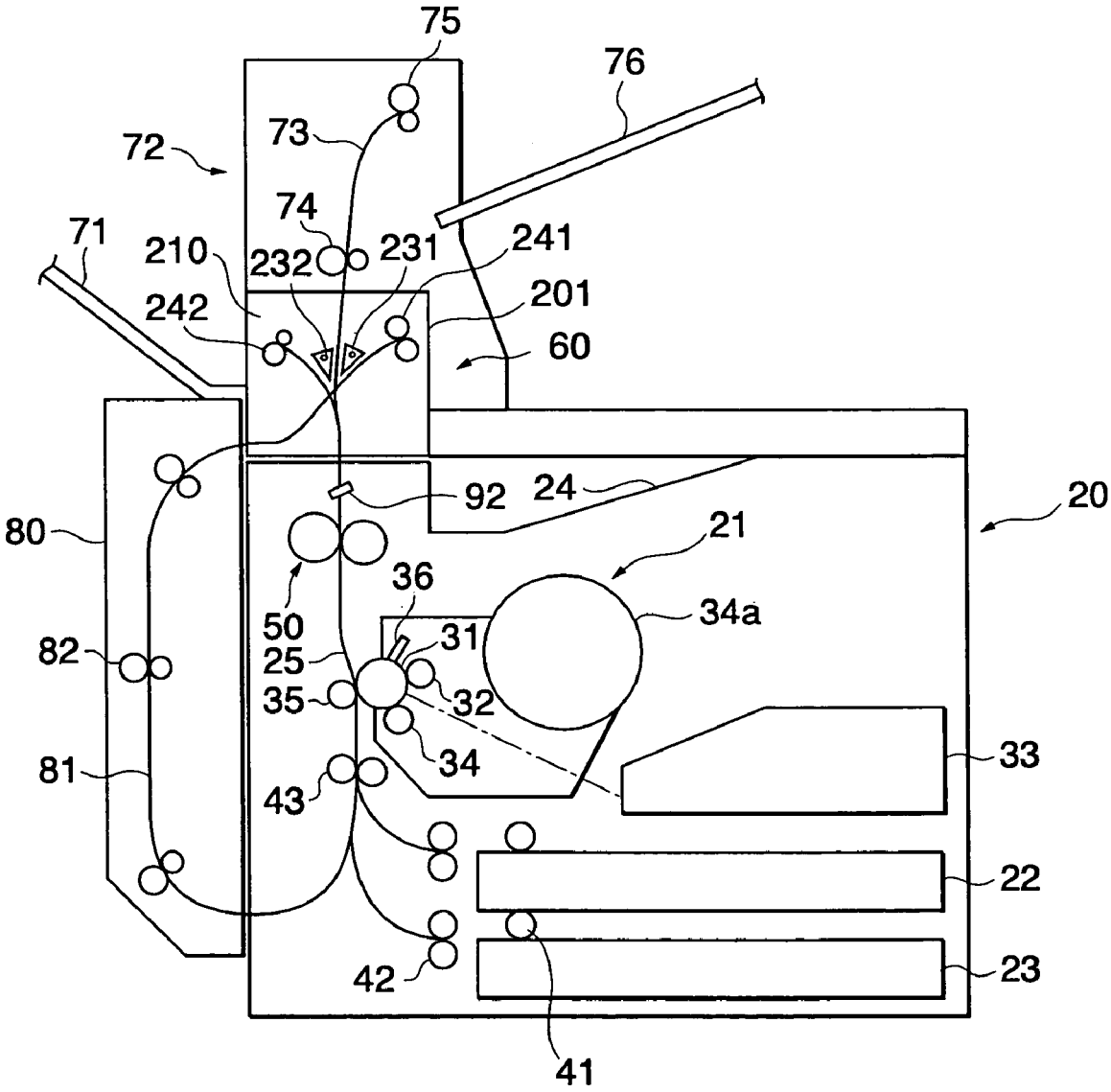
FIG. 9 is an explanatory view showing a sheet processing device to which the present invention is applied according to an embodiment 2.

FIG. 9 is an explanatory view showing a sheet processing device (image forming device in this embodiment) to which the present invention is adopted according to the embodiment 2.

In this figure, the basic construction of the image forming device is approximately the same as that in the embodiment 1, but the construction around the sheet discharge unit is different from that in the embodiment 1. The same components as the embodiment 1 are given by the same numerals for omitting detailed explanation thereof.

In this embodiment, a sheet discharge unit 201 is exchanged with the sheet discharge unit 61 (having the construction of being capable of discharging a sheet in two directions) used in the embodiment 1. Examples of the sheet discharge unit 201 include a sheet discharge unit with various specifications wherein a discharge position of the sheet is varied according to the accommodatable number of discharge sheet of the discharge tray 24 or a sheet discharge unit 201 with a large capacity (e.g., 500 sheets) of the accommodatable number of discharge sheet.

Figure 10:
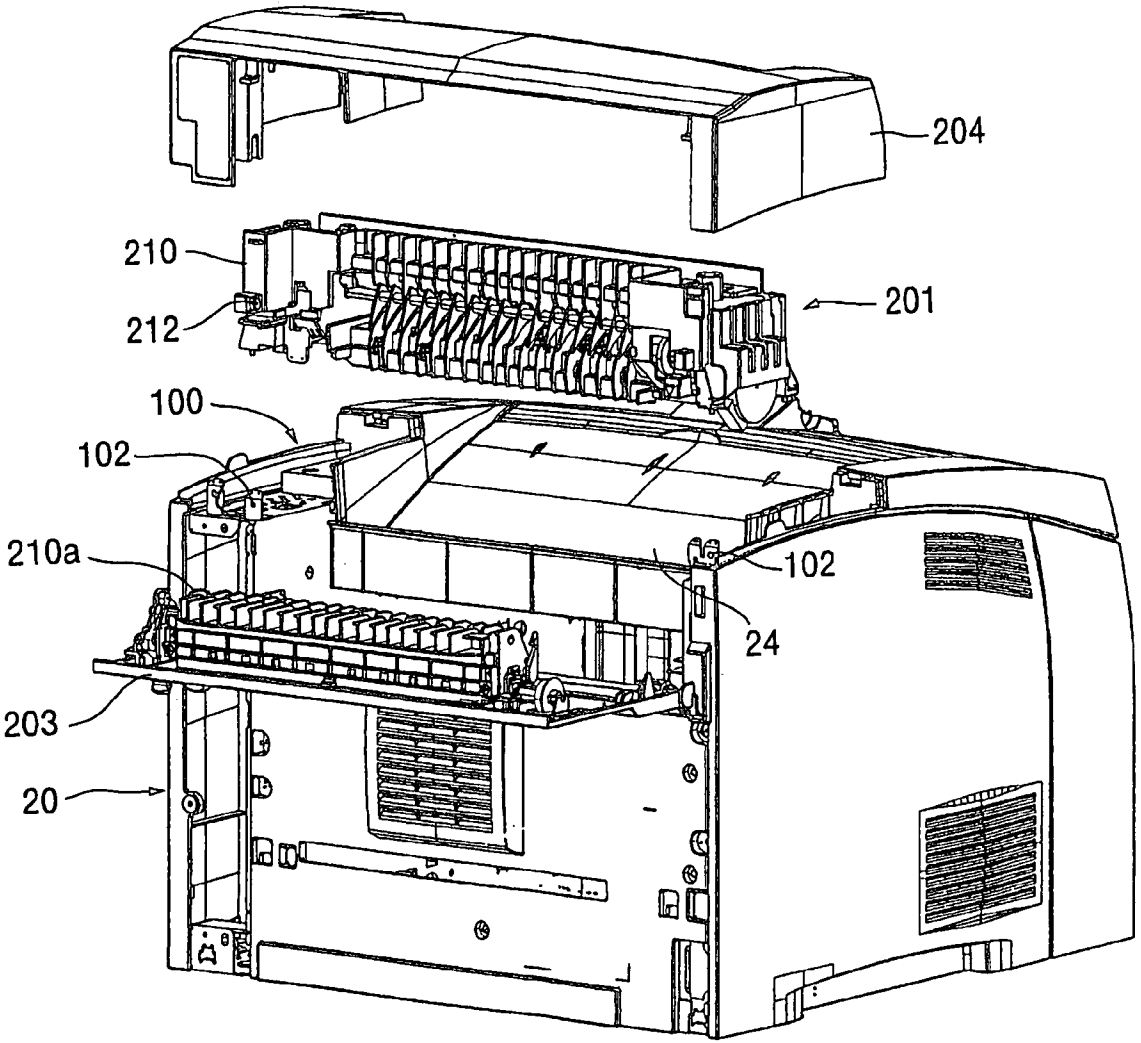
FIG. 10 is a perspective view showing a mounting structure of a sheet discharge unit used in the present embodiment.
Figure 11:
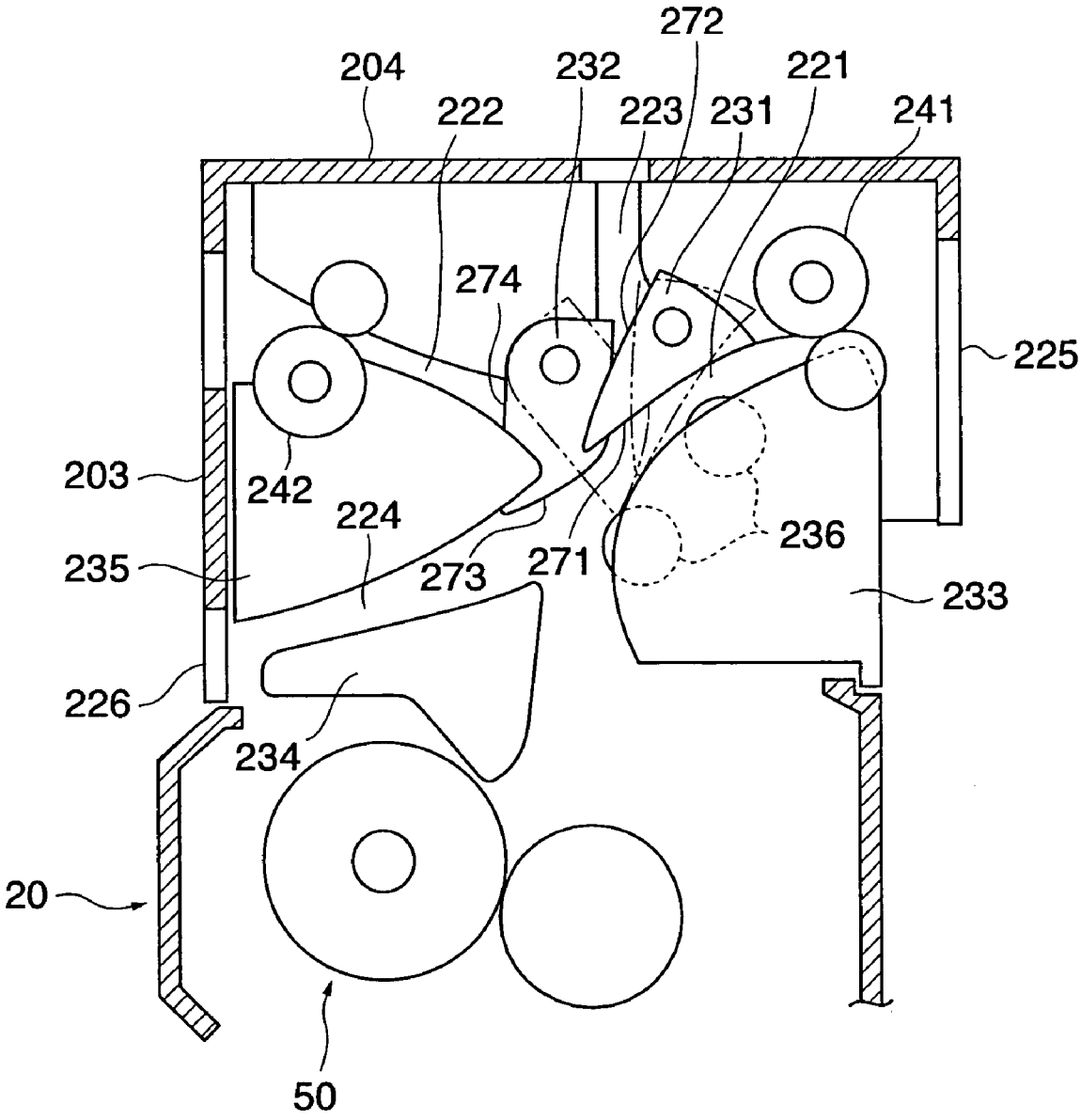
FIG. 11 is an explanatory view showing details of the sheet discharge unit used in the present embodiment.

The present embodiment utilizes a sheet discharge unit 201 having an embodiment of discharging a sheet in four directions as shown in FIGS. 9 to 11.

Specifically, this sheet discharge unit 201 has branch discharge paths 221 to 223 branched in three directions in the unit body 210. The first branch discharge path (corresponding to the normal discharge path) 221 extends toward the discharge tray 24 at the upper section of the device body 20 while the second branch discharge path 222 extends toward the direction opposite to the first branch discharge path 221. Further, the third branch discharge path 223 extends toward approximately upward direction in the middle of the first and second branch discharge paths 221 and 222. A face-up tray 71 is disposed at the outside of the outlet of the second branch discharge path 222, while another option unit 72 is disposed above the third branch discharge path 223.

In this embodiment, an offset catch tray (OCT) that offsets the sheet to be discharged is, for example, used as the option unit 72. This option unit 72 is provided with a sheet discharge path 73, transport roller 74, discharge roller 75 and tray 76.

A duplex unit 80 is attached to the device body 20. When a duplex mode is selected for performing an image recording on both sides of the sheet, this duplex unit 80 takes the sheet having one side recorded therein from the sheet discharge device 60, transports the sheet along an internal sheet returning transport path 81 with the transport roller 82 of a suitable number and feeds the sheet again to the resist roller 43.

As shown in FIG. 11, the sheet discharge unit 201 according to this embodiment is provided with a reverse discharge path 224 extending from the first branch discharge path 221 toward the reverse-discharge direction up to the discharge port 226, in addition to three branch discharge paths 221 to 223 branched in the unit body 210. The reverse discharge path 224 is connected to communicate with the sheet returning transport path 81 of the duplex unit 80.

The first branch discharge path 221 is formed by two gates 231 and 232 and lower guide member 233 while the reverse discharge path 224 is formed by an upper guide member 235 and a lower guide member 234 serving also as a fixed gate.

Further, a pair of discharge rollers 241 and 242 are disposed in the vicinity of the discharge port of the first and second branch discharge paths 221 and 222. Moreover, switchable two gates 231 and 232 are arranged so as to be opposite to each other via the third branch discharge path 223 in the vicinity of the crossing section of the branch discharge paths 221 to 223. Numeral 236 denotes a roller disposed to the first branch discharge path 221, numeral 50 denotes a fixing device mounted in the device body 20 and numeral 225 denotes a discharge port of the branch discharge path 221.

In this embodiment, the discharge rollers 241 and 242 are configured such that a driving roller and a driven roller are brought into contact with each other for causing rotation.

Further, the first gate 231 is constituted of a gate member having approximately a triangular shape. This gate member is constituted of gate member both side sections serving as guide faces 271 and 272 and extending toward the crossing section of the branch discharge paths. It operates to pivotably switch over between a position shown by a solid line (a position for covering the third branch discharge path 223 with the second gate 232 to thereby guide the sheet to the first branch discharge path 221 along the guide face 271) and a position shown by a virtual line (a position for covering the first branch discharge path 221 to thereby guide the sheet to the third branch discharge path 223 along the guide face 272 with the second gate 232).

On the other hand, the second gate 232 is similarly constituted of a gate member having approximately a triangular shape. This gate member is constituted of gate member both side sections serving as guide faces 273 and 274 and extending toward the crossing section of the branch discharge paths. It operates to pivotably switch over between a position shown by a solid line (a position for covering the second branch discharge path 222 to thereby guide the sheet to the third branch discharge path 223 along the guide face 273 with the first gate 231) and a position shown by a virtual line (a position for covering the third branch discharge path 223 with the first gate 231 to thereby guide the sheet to the second branch discharge path 222 along the guide face 274).

Figure 12:
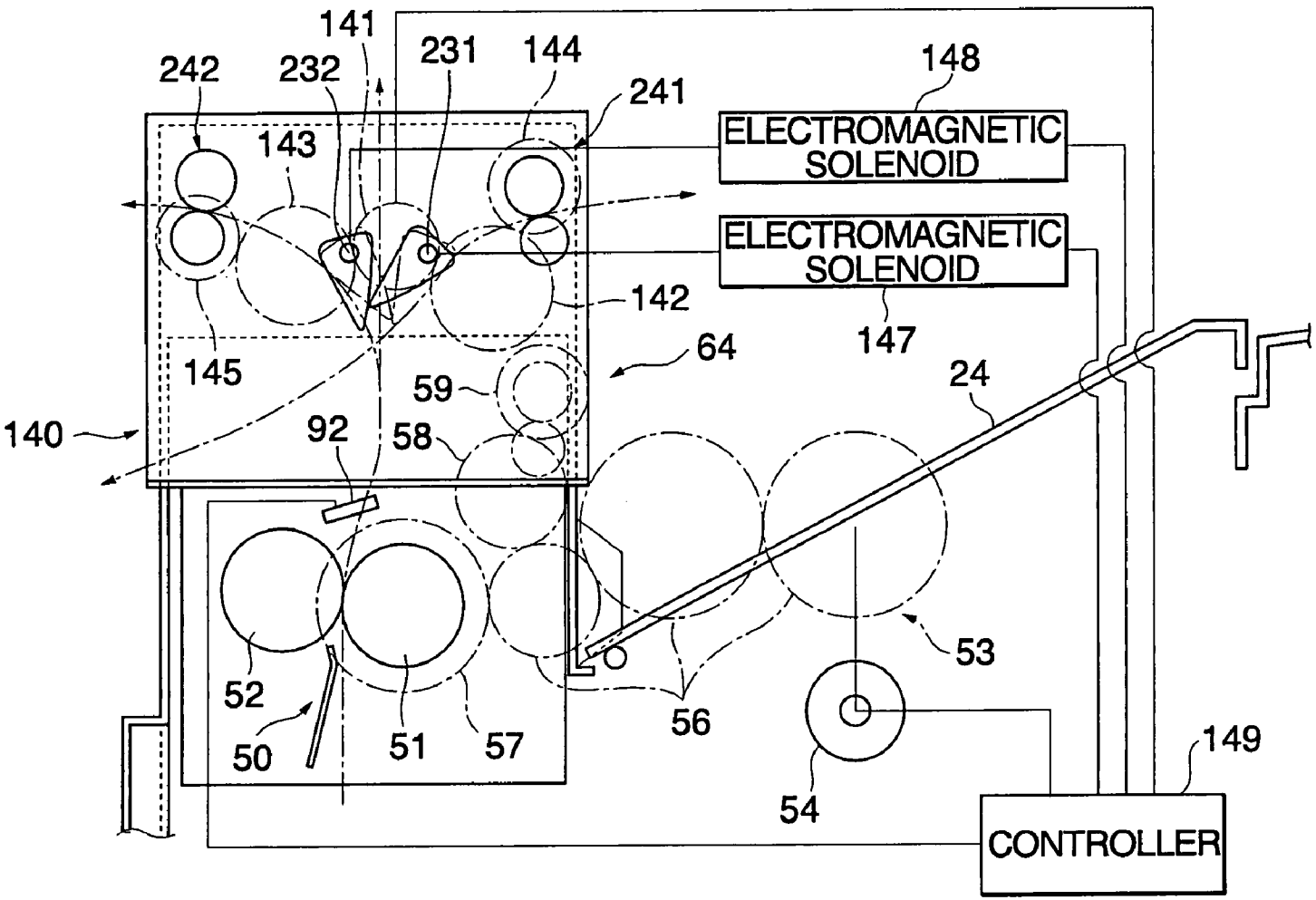
FIG. 12 is an explanatory view showing a driving system of the sheet discharge unit used in the present embodiment.

FIG. 12 shows a driving force transmission system of the sheet discharge unit 201 used in this embodiment.

In the same figure, a driving force transmission system 140 transmits driving force from a driving motor 141 that can rotate in the normal and reverse directions to a driven gear 144 coaxially disposed to the driving roller of the first discharge roller 241 via a transmission gear 142, and further transmits the same to a driven gear 145 coaxially disposed to the driving roller of the second discharge roller 242 via a transmission gear 143.

In this embodiment, the fixing device 50 has a heat-fixing roller 51 having a heat source incorporated therein and a pressure-fixing roller 52 that comes in contact with the heat-fixing roller 51 with a predetermined nip pressure to be rotated. This fixing device 50 is driven to be rotated by an another driving force transmission system 53.

Specifically, in this embodiment, a driven gear 57 coaxially disposed to the heat-fixing roller 51 is geared with a gear train 56 for producing a predetermined reducing ratio, whereby the driving force transmission system 53 transmits driving force from a driving motor 54 to the heat-fixing roller 51.

Further, the driving force transmission system 140 performs a switching operation of the first and second gates 231 and 232 via an electromagnetic solenoids 147 and 148.

The driving motor 141, electromagnetic solenoids 147 and 148 of the driving force transmission system 140 are controlled to be driven according to a control signal in accordance with an image-forming control program (including a sheet discharge control program) from a controller 149. A detection signal from the discharge sensor 92 and the like is inputted to the controller 149 to be used for the production of the control signal.

The sheet discharge unit 201 is removably attached to the unit receiving section 100 at the upper section of the device body 20 as shown in FIG. 10.

In this case, a locking projection (not shown) and screw bearing recess section 212 as an engaging section are provided at a unit body 210 while a locking hole (not shown) and a screwed member 102 as an engaged section that can be engaged with the engaging sections 111 and 112 are provided at the unit receiving section 100 as shown in FIG. 10. The sheet discharge unit 61 is attached such that the engaging sections are engaged with the engaged sections 101 and 102 for fixing the sheet discharge unit 201 with a screw (not shown).

It is to be noted that, in this embodiment, a part 210*a* of the unit body 210 is removably attached to an opening/closing door 203 of the device body 20. Further, numeral 204 in the figure denotes an outer cover of the sheet discharge unit 201.

Subsequently, attention is paid on the sheet discharge device 60 according to this embodiment, the operation of which will be explained.

In this embodiment, a sheet is controlled to be discharged according to, for example, various sheet discharge modes described below.

Face-Down Discharge Mode

This is the mode in which the sheet S is discharged onto the discharge tray 24 with its image-bearing surface facing downward.

Figure 13A:
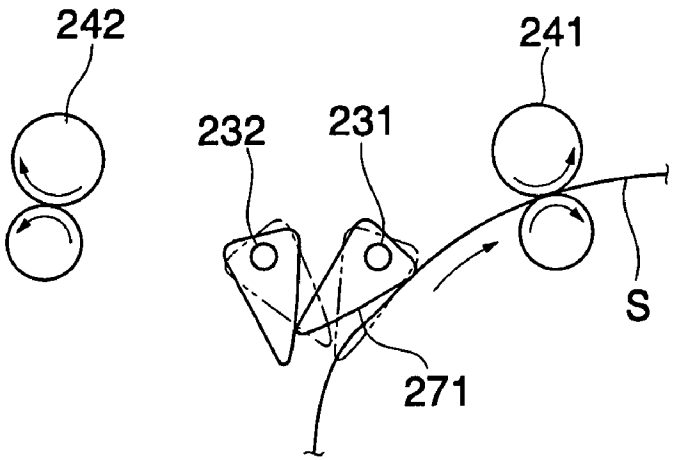
FIGS. 13A to 13D are explanatory views showing a switching operation for discharging a sheet in the present embodiment.

In this case, two gates 231 and 232 perform the switching operation as shown in FIG. 13A for covering the second and third branch discharge paths 222 and 223 and opening the first branch discharge path 221 to thereby guide the sheet S along the guide face 271 of the first gate 231. Then, the discharge roller 241 is driven to be rotated in the normal direction to thereby nip the sheet S and transport the same (see FIG. 9).

Face-Up Discharge Mode

This is the mode in which the sheet S is discharged onto the face-up tray 71 with its image-bearing surface facing upward.

Figure 13B:
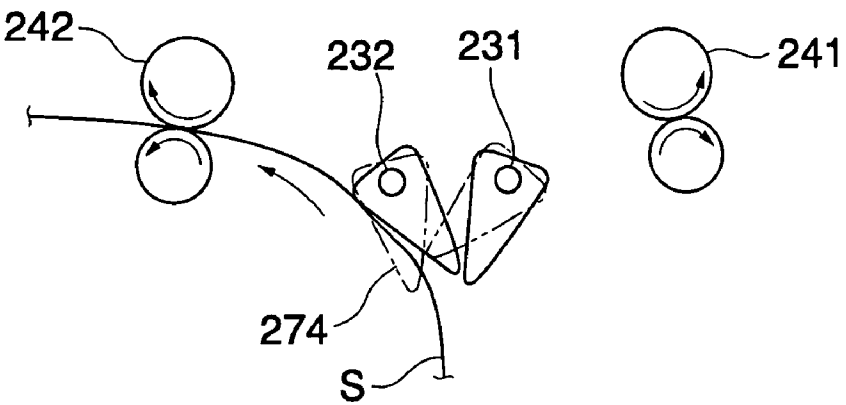

In this case, two gates 231 and 232 perform the switching operation as shown in FIG. 13B for covering the first and third branch discharge paths 221 and 223 and opening the second branch discharge path 222 to thereby guide the sheet S along the guide face 274 of the second gate 232. Then, the discharge roller 242 is driven to be rotated in the normal direction to thereby nip the sheet S and transport the same (see FIG. 9).

When the face-up discharge mode is executed, a curl is formed on the sheet S in a predetermined direction when the sheet S passes through the fixing device 50, in particular. However, the curl of the sheet S is naturally corrected without providing a curl-correction device, since the second branch discharge device 222 extends toward the direction for correcting the curl of the sheet S.

OCT Discharge Mode

This is the mode in which the sheet S is discharged to the OCT that is the option unit 72.

Figure 13C:
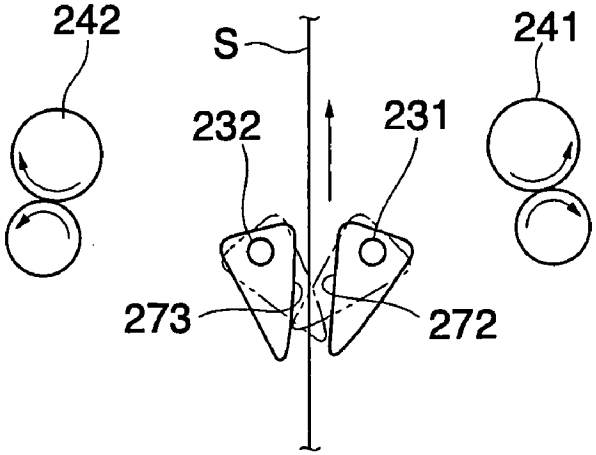

In this case, two gates 231 and 232 perform the switching operation as shown in FIG. 13C for covering the first and second branch discharge paths 221 and 222 and opening the third branch discharge path 223 to thereby guide the sheet S along the guide faces 272 and 273 of the first and second gates 231 and 232 (see FIG. 9).

Sheet Reversing Control in Duplex Recording Mode

This is a sheet transporting control in which the sheet S having one side recorded is returned to the duplex unit 80 upon the duplex recording mode.

Figure 13D:
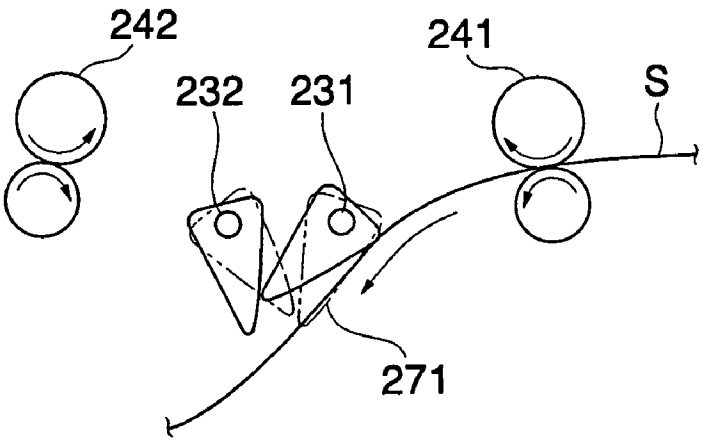

In this case, the two gates 231 and 232 perform the switching operation as shown in FIG. 13D, whereby the sheet S having one side recorded is guided toward the first branch discharge path 221. After the discharge roller 241 is driven to be rotated in the normal direction to thereby nip the sheet S and transport the same by a predetermined amount, the normal rotation of the discharge roller 241 is switched to the reverse rotation when the sheet S goes over the vicinity of the crossing section of the branch discharge paths, whereby the sheet S nip-held by the discharge roller 241 is transported in the first branch discharge path 221 in the reverse direction, guided to be transported to the reverse discharge path 224 communicating with the first branch discharge path 221 in an approximately linear manner, and then, transported to the duplex unit 80 (see FIG. 9).

The operation timing of both discharge rollers 241 and 242 and both gates 231 and 232 are controlled based upon the detection signal from the discharge sensor 92.

If the opposing surfaces of two gates 231 and 232 are formed into a comb tooth for engaging with each other in this embodiment, switching the mode from the face-down discharge mode to the face-up discharge mode can be carried out only by switching the second gate 232 from the position shown by the virtual line to the position shown by the solid line as shown in FIG. 13B with the first gate 231 kept to be at the unchanged position (the position shown by the solid line in FIG. 13A).

This embodiment allows to simply perform the switching control of the first and second gates 231 and 232.

Figure 14:
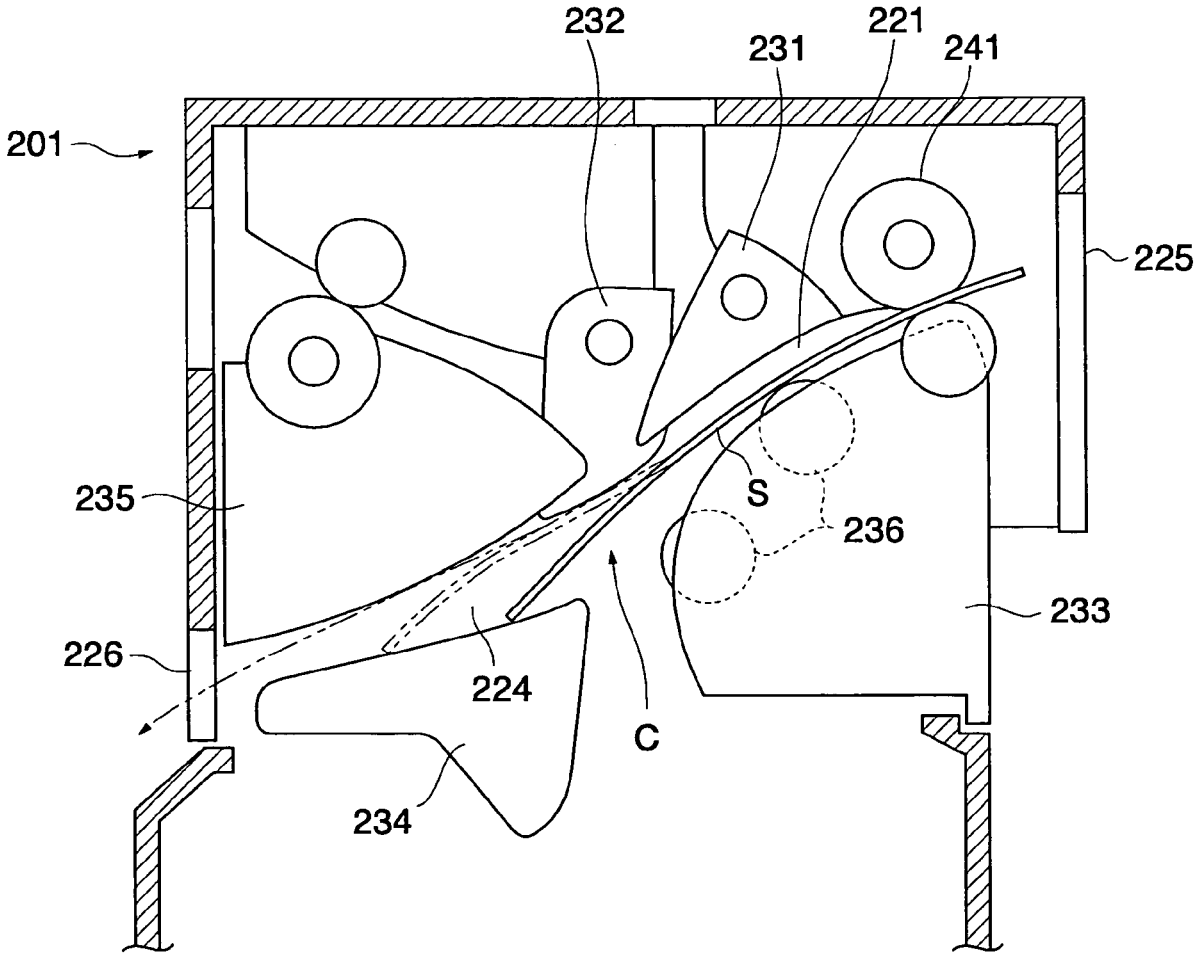
FIG. 14 is an explanatory view showing an operation when a thick paper is transported in the present embodiment.

Subsequently explained along FIG. 14 is a detailed operation during the process for reversing and discharging the sheet in this embodiment. In this embodiment too, the explanation is made mainly about the transporting state of a thick paper (specifically, a paper with approximately 200 $g/m^2$ compared to a normal paper with 64 $g/m^2$), like the embodiment 1.

The sheet S reversed to be discharged by the discharge roller 241 is transported along the first branch discharge path 221 formed by the first gate 231 and the lower guide member 233. When the leading edge of the sheet S reaches the lower guide member (fixed gate) 234, the sheet is continued to be transported along the fixed gate 234. A guide is not particularly provided at the lower section in the vicinity of the crossing section C of the reverse discharge path 224, but the fixed gate 234 is positioned such that the leading edge of the sheet S accurately reaches the fixed gate 234 due to the stiffness of the transported sheet S.

Further, in the reverse discharge path 224, the upper guide member 235 defining the upper wall section of the reverse discharge path 224 does not block a linear reference surface connecting the nipping section of the discharge roller 241 and the lower edge of the discharge port 226 of the reverse discharge path 224, so that the sheet S is directed toward the discharge port 226 with no problem in the transportability of the sheet S in the reverse discharge path 224.

Moreover, a roller 236 is disposed to the first branch discharge path 221 for further improving the transportability of the sheet S. The upper guide member 235 defining the upper wall section of the reverse discharge path 224 is positioned above the extending surface of the lower surface of the first gate 231, that also plays a role for improving the transportability.

Figure 15:
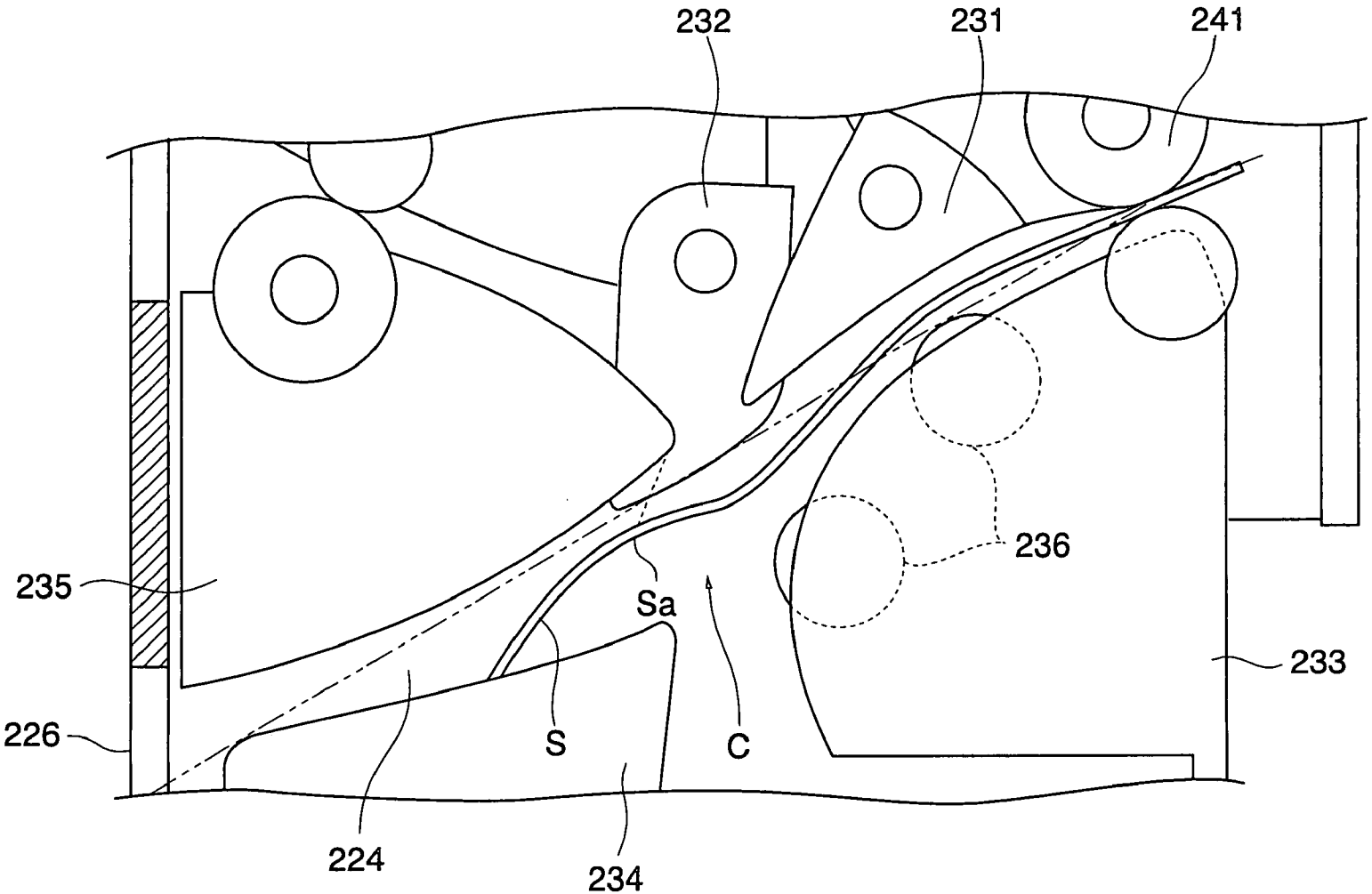
FIG. 15 is an explanatory view showing an operation when a thick paper is transported in a reference embodiment.

If the upper guide member 235 of the reverse discharge path 224 is disposed below as shown by a broken line in FIG. 15, the space in the vicinity of the crossing section C becomes narrow, so that the section Sa in the vicinity of the leading edge of the sheet S in the reverse discharge path 224 comes in contact with the upper guide member 235 of the reverse discharge path 224, that buckles the sheet S from around the section Sa. Therefore, frictional resistance at this section becomes great, thereby extremely deteriorating transportability of the sheet S. A one-dot-chain line indicates a linear reference surface connecting the nipping section of the discharge roller 241 and the lower edge of the discharge port 226.

Further, it is needless to say that the sheet S reversed to be discharged is not warranted to be surely transported to the reverse discharge path 224 if the space in the vicinity of the crossing section C is narrow.

As described above, the sheet processing device according to the present embodiment has the sheet discharge unit 201 having a sheet discharge capacity of, for example, 500 sheets, wherein a sheet can accurately be transported to the external unit provided in the reverse-discharge direction of the sheet and further, there is a possibility that a type of sheet that can be handled widely ranges.

In particular, the position of the discharge port 226 of the reverse discharge path 224 in this embodiment is set to the same position as the discharge port 127 of the reverse discharge path 63 of the sheet discharge unit 61 in the embodiment 1.

Accordingly, the external unit can be commonized since the discharge ports of the reverse discharge paths in plural sheet discharge units are set to the same position.

Although the sheet discharge unit 201 in this embodiment has a configuration of having discharge paths in four directions including the reverse discharge path, it is not limited thereto. It may have a configuration of having at least one normal discharge path and a reverse discharge path to which a sheet is reversed to be discharged from the normal discharge path.

In this embodiment, the sheet discharge unit 201 is removable from the unit receiving section 100 of the device body 20, whereby the sheet discharge unit 61 used in the embodiment can be exchanged for the sheet discharge unit 201 according to this embodiment if the unit receiving section 100 is provided with a mounted structure with respect to the sheet discharge units 61 and 201 each having a different specification.

In this embodiment, if there is an exchange between the sheet discharge units 61 and 201, the position of the discharge sensor 92 is unchanged even if the sheet discharge unit 201 having a different specification is attached, since the discharge sensor 92 is disposed to the device body 20. Therefore, a sheet discharge control approximately the same as that before the exchange can be applied.

Embodiment 3

Figure 16:
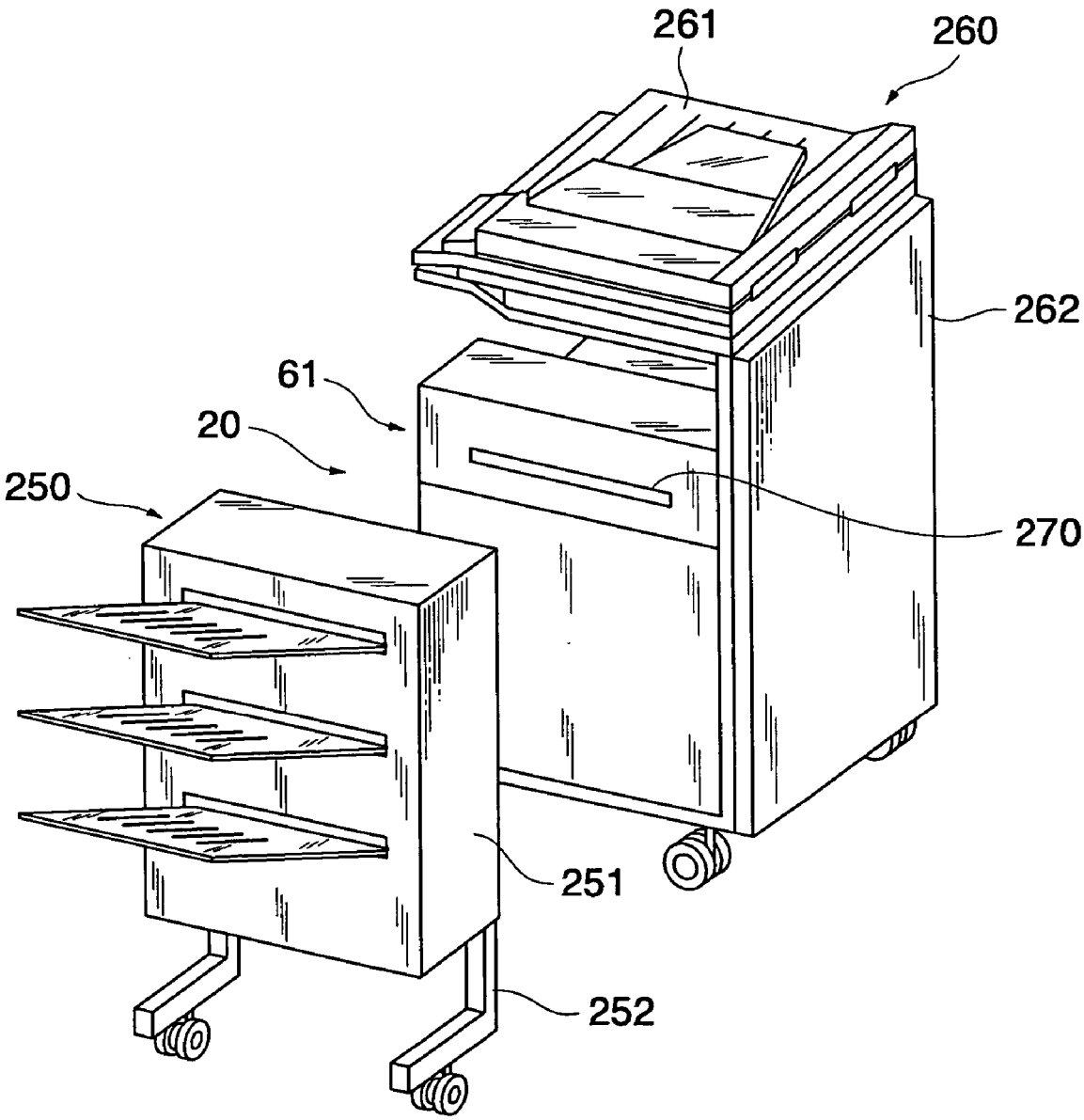
FIG. 16 is an explanatory view showing a sheet processing device to which the present invention is applied according to an embodiment 3.

FIG. 16 is a perspective view of a sheet processing device (an image forming device having an external unit attached thereto in this embodiment) to which the present invention is applied according to the embodiment 3.

In the same figure, the basic construction of the image forming device is approximately the same as that of the embodiment 1. The different points from the embodiment 1 are that a sorter 250 is applied, as a post-processing device, to the discharge port 270 of the reverse discharge path in the sheet discharge unit 61 and that an image reading device 260 is mounted to the device body 20.

In the same figure, a main body 251 of the sorter 250 is mounted on a frame 252, while a main body 261 of the image reading device 260 is mounted on a frame 262.

The discharge port 270 of the reverse discharge path in the device body 20 is positioned at the same position of a paper feeding port (not shown) of the sorter 250, thereby providing no problem in the sheet transportability.

Although this embodiment uses the sheet discharge unit 61 of the embodiment 1, it is needless to say that the same post-processing device can be used even if the other sheet discharge unit 201 used in the embodiment 2 is utilized.

As explained above, the present invention enables to removably attach plural sheet discharge units, each having a different specification, to a unit receiving section of a processing device body, whereby a sheet discharge unit can be attached according to a demand of a user, thereby being capable of easily changing an accommodatable number of discharge sheet (capacity of discharge sheet).

Further, a unit having the same specification as those of plural sheet discharge units, each having a different specification, can be used for an external unit such as a duplex unit and the like, thereby meeting a reduction in an investment by the user or various needs of the user.

Moreover, the sheet processing device using such sheet discharge device can simply cope with a change in the specification of processing ability of a sheet, since the capacity of the discharge sheet can easily be changed.

Additionally, even if the capacity of the discharge sheet is increased, the height of the sheet processing device can be held down, since the sheet discharge unit incorporated as a part of the processing device body is removably attached, thereby being capable of assuring a miniaturization of the device itself.

Moreover, the sheet discharge unit can cope with the case where the capacity of the discharge sheet is increased, whereby an additional external unit is unnecessary, and consequently, cost can be reduced by the unnecessary additional external unit.

The entire disclosure of Japanese Patent Application No. 2003-132203 filed on May 9, 2003 including specification, claims, drawings and abstract is incorporated herein by reference in its entirety.

What is claimed is:

1. A plurality of sheet discharge units, each of which is configured to be mounted on a sheet processing apparatus, each of the sheet discharge units comprising:

a sheet discharge unit body;

a sheet transport path including a normal transport path and a reverse transport path;

a sheet entering port, located adjacent a periphery of the sheet discharge unit body, from which a sheet output from the sheet processing apparatus enters the normal transport path;

a first sheet discharge port positioned at the end of the normal transport path; and a second sheet discharge port positioned at the end of the reverse transport path;

wherein the sheet entering port of each of the sheet discharge units is arranged at a same position on each of the plurality of sheet discharge unit bodies, and the second sheet discharge port of each of the sheet discharge units is arranged at a same position on each of the plurality of sheet discharge unit bodies, wherein the first sheet discharge ports of the respective sheet discharge units are arranged at different vertical positions with respect to the sheet entering ports.

2. The plurality of sheet discharge units configured to be mounted on a sheet processing apparatus according to claim 1, wherein the first sheet discharge port of each of the respective sheet discharge units are arranged at a different position on each of the sheet discharge units.

3. The plurality of sheet discharge units configured to be mounted on a sheet processing apparatus according to claim 1, wherein each of the sheet discharge units is removable from the sheet processing apparatus.

4. The plurality of sheet discharge units configured to be mounted on a sheet processing apparatus according to claim 1, wherein each of the sheet discharge units is provided with a discharge member disposed proximate to an upper surface of a sheet stacking section provided at an upper section of the sheet processing apparatus.

5. The plurality of sheet discharge units configured to be mounted on a sheet processing apparatus according to claim 1, wherein a discharge capacity is adjusted according to a sheet transporting speed of the sheet processing apparatus for the plurality of sheet discharge units.

6. The plurality of sheet discharge units configured to be mounted on a sheet processing apparatus according to claim 1, wherein a discharge capacity is adjusted according to a sheet feeding amount of the sheet processing apparatus for the plurality of sheet discharge units.

7. The plurality of sheet discharge units configured to be mounted on a sheet processing apparatus according to claim 1, wherein a discharge capacity is adjusted according to a sheet processing amount of the sheet processing apparatus for the plurality of sheet discharge units.

8. The plurality of sheet discharge units configured to be mounted on a sheet processing apparatus according to claim 1, wherein a discharge member is mounted in the vicinity of the first sheet discharge port of the normal transport path, and at least upper and lower surfaces of the reverse transport path are formed not to block a linear reference surface connecting a nipping section of the discharge member and a lower edge of the second sheet discharge port of the reverse transport path.

9. The plurality of sheet discharge units configured to be mounted on a sheet processing apparatus according to claim 1, wherein an upper surface of the reverse transport path is upwardly withdrawn from extending into an upper surface of the normal transport path.

10. The plurality of sheet discharge units configured to be mounted on a sheet processing apparatus according to claim 1, wherein lower surfaces of the normal transport path and the reverse transport path are formed into an approximately V-shape for widening a space in the vicinity of a crossing section of the normal transport path and the reverse transport path.

11. The plurality of sheet discharge units configured to be mounted on a sheet processing apparatus according to claim 1, wherein the plurality of sheet discharge units is capable of interfacing with a common external unit.

12. A sheet processing device comprising:

a plurality of sheet discharge units, each of which is incorporated as part of a processing device body, and discharges a sheet processed at a processing section in the processing device body toward a sheet stacking section disposed at an upper section of the processing device body;

each of the sheet discharge units comprising:

a sheet discharge unit body;

a sheet transport path including a normal transport path and a reverse transport path;

a sheet entering port, located adjacent a periphery of the sheet discharge unit body, from which a sheet output from the processing device body enters the normal transport path;

a first sheet discharge port positioned at the end of the normal transport path; and a second sheet discharge port positioned at the end of the reverse transport path;

wherein the sheet entering port of each of the sheet discharge units is arranged at a same position on each of the plurality of sheet discharge unit bodies, and the second sheet discharge port of each of the sheet discharge units is arranged at a same position on each of the plurality of sheet discharge unit bodies, wherein the first sheet discharge ports of the respective sheet discharge units are arranged at different vertical positions with respect to the sheet entering ports.

13. The sheet processing device according to claim 12, wherein each sheet discharge unit has the normal discharge path communicating with the sheet stacking section and the reverse transport path extending in a direction substantially opposite to the normal discharge path.

14. The sheet processing device according to claim 12, wherein an external unit is added to the second sheet discharge port of the reverse transport path.

15. The sheet processing device according to claim 14, wherein the external unit is a duplex unit.

16. The sheet processing device according to claim 14, wherein the external unit is a post-processing unit.

* * * * *